US005937590A

United States Patent [19]

Richardson

[11] Patent Number: 5,937,590

[45] Date of Patent: Aug. 17, 1999

[54] CONSERVATORY ROOFS

[75] Inventor: Christopher Richardson, Clitheroe, United Kingdom

[73] Assignee: Ultraframe (UK) Ltd. of Enterprise Works, Lancashire, United Kingdom

[21] Appl. No.: 08/987,675

[22] Filed: Dec. 9, 1997

[30] Foreign Application Priority Data

Mar. 14, 1997 [GB] United Kingdom ..... 9705307

[51] Int. Cl.[6] ..... E04B 7/02

[52] U.S. Cl. ..... 52/90.1; 52/82

[58] Field of Search ..... 52/90.1, 645, 655.1, 52/656.9, 82; 403/230, 59, 13, 119, 122; 411/84, 107

[56] References Cited

U.S. PATENT DOCUMENTS

| | | | |
|---|---|---|---|
| 2,826,466 | 3/1958 | Pritchard | 308/207 |
| 3,375,029 | 3/1968 | Frye et al. | 287/189.35 |
| 5,489,161 | 2/1996 | Sugita et al. | 403/134 |
| 5,618,127 | 4/1997 | Tonsmann et al. | 403/230 |

FOREIGN PATENT DOCUMENTS

| | | | |
|---|---|---|---|
| 0094300 | 11/1983 | European Pat. Off. . | |
| 2006380 | 5/1979 | United Kingdom . | |
| 2153038 | 8/1985 | United Kingdom . | |
| 2235476 | 6/1991 | United Kingdom | 52/82 |
| 2250793 | 6/1992 | United Kingdom . | |
| 2256880 | 12/1992 | United Kingdom . | |

*Primary Examiner*—Carl D. Freidman
*Assistant Examiner*—Dennis L. Dorsey
*Attorney, Agent, or Firm*—Quarles & Brady LLP

[57] ABSTRACT

A system for connecting a jack rafter to a main beam for forming a conservatory roof comprises a first part mountable on the main beam and a second part connectable to the jack rafter, the first and second parts being pivotally connected, whereby they are movable to achieve a desired position for the jack rafter relative to the main beam.

9 Claims, 5 Drawing Sheets

CONSERVATORY ROOFS

BACKGROUND OF THE INVENTION

This invention concerns conservatory roofs and in particular connection of jack rafters to main glazing beams.

In, for example, so-called Georgian style conservatory roofs, it is common to have main glazing beams at roof ends extending from one end of a central ridge to corners of the roof and to have so-called jack rafters, extending from both sides of such a beam between its ends to the eaves of the roof. Because the angle of attachment of such rafters to a main beam can vary in two directions due to the size and pitch of the roof, special connecting brackets for the rafters have to be made for each roof or rather less satisfactorily the rafter end is cut to abut against the main beam and the connection made by screws through the rafter into the main beam. The screw connection is one that can become loose with time.

Either of the above arrangements takes time to construct and hence affects the expense of construction of a conservatory roof.

SUMMARY OF THE INVENTION

An object of this invention is to provide a means for connecting a jack rafter to a main beam in forming a conservatory or like roof.

According to the invention there is provided a system for connecting a jack rafter to a main beam for forming a conservatory roof comprising a first part mountable on the main beam and a second part connectable to the jack rafter, said first and second parts being connectable and relatively pivotable to achieve a desired position for the rafter relative to the main beam.

The connection of the first and second parts of the connecting system of the invention preferably permits relative pivoting of said parts both relative to a vertical plane through the main beam and to a plane normal to the vertical plane of the main beam.

The first part of the connector preferably has a part to take a connecting bolt or the like, which part has a rounded top surface. The second part of the connector preferably includes a bar with a hole in one end to fit onto the connecting bolt. The second part of the connector preferably has a concave underside or a washer or the like with a concave underside is interposed between the first and second parts of the connector.

The system of the invention is preferably used with glazing bars that have a ducted web, in which case the bar of the second part may be used as a tenon slotted into the ducted web of the jack rafter.

The relative pivoting of the two connector parts allows a jack rafter to be connected at a desired angle relative to a main beam according to the pitch and size of the roof.

BRIEF DESCRIPTION OF THE DRAWINGS

This invention will now be further described, by way of example only, with reference to the accompanying drawings, in which.

DETAILED DESCRIPTION OF THE INVENTION

Figure 1:
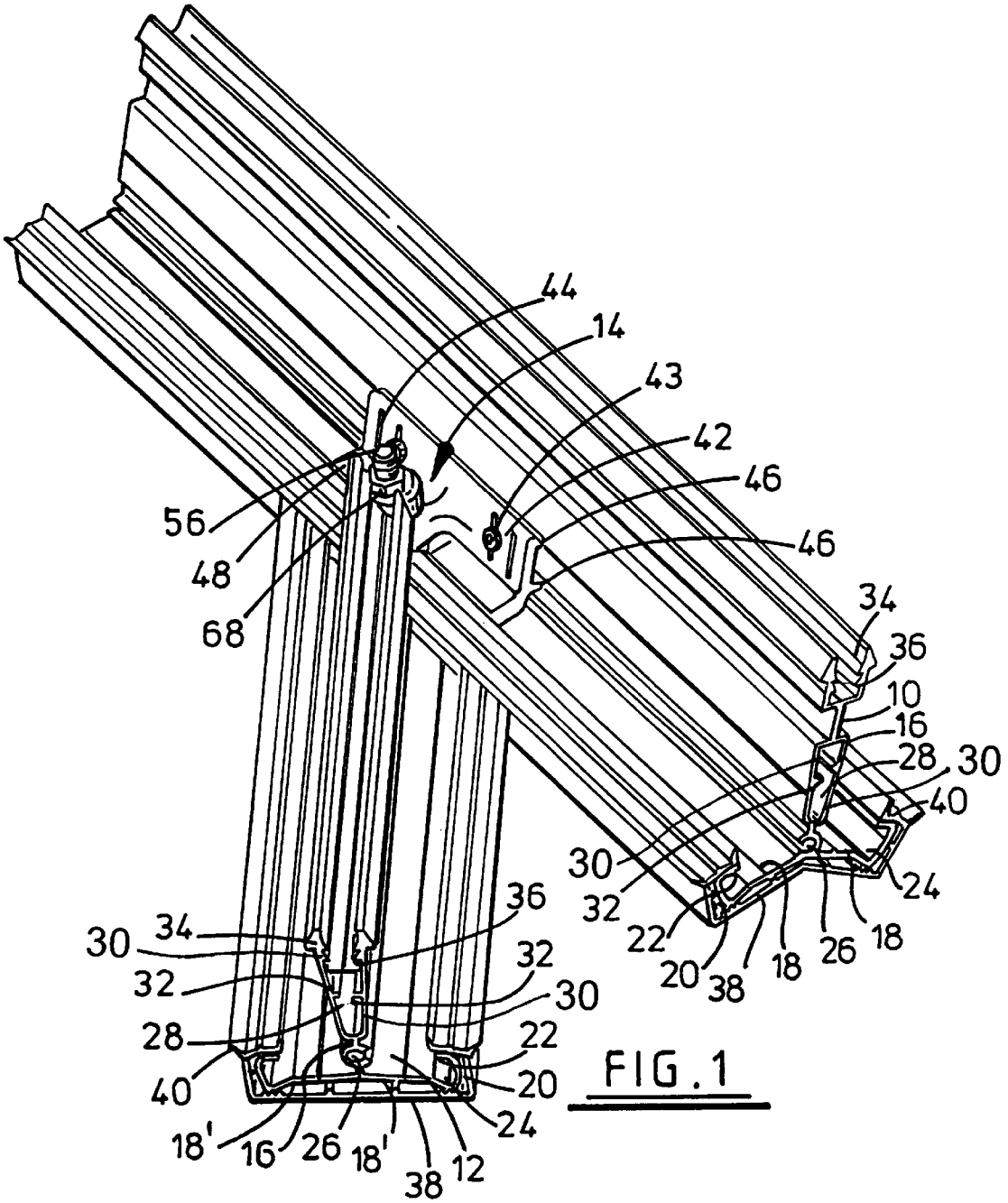
FIG. 1 shows a jack rafter arrangement according to the invention.
Figure 2:
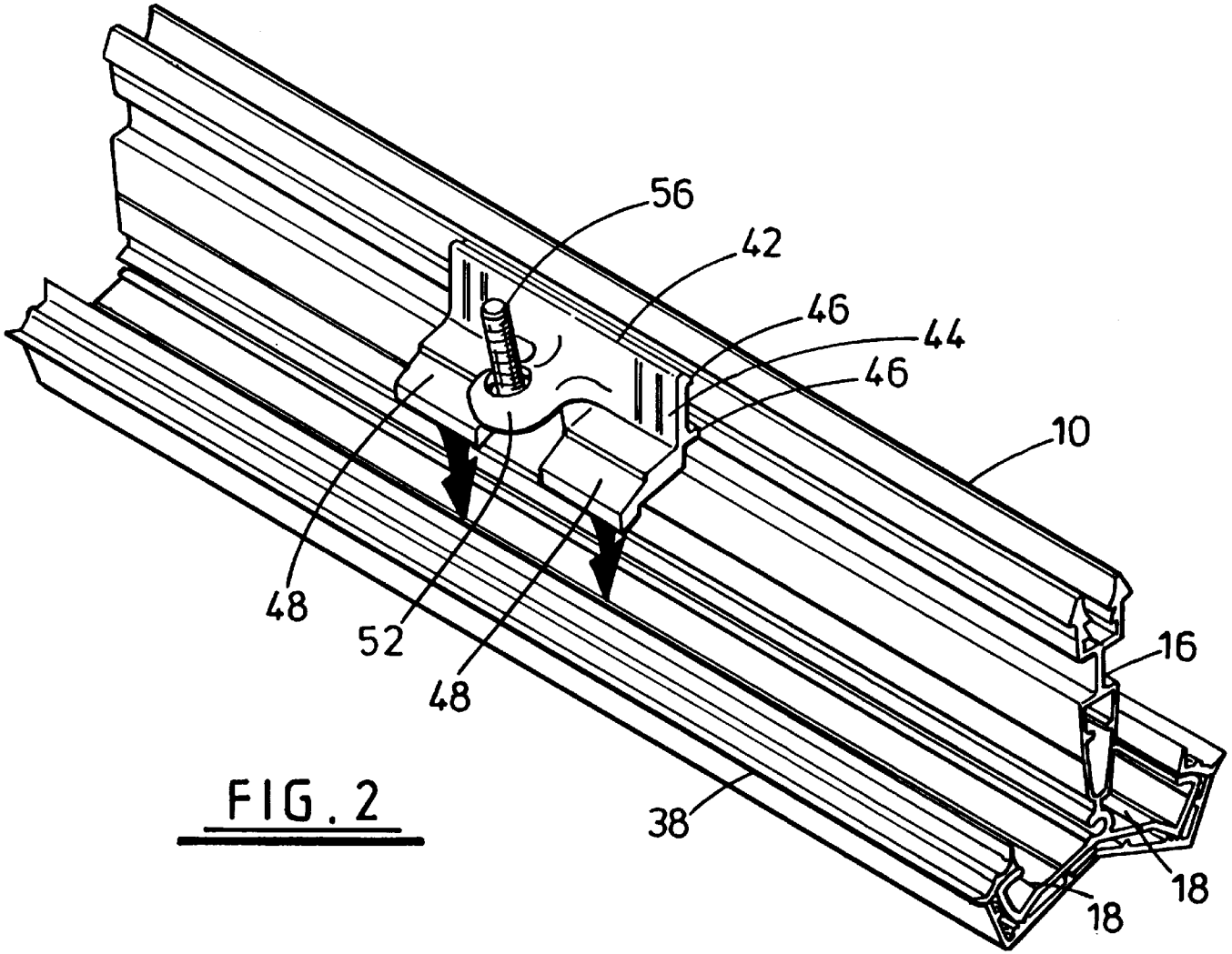
FIGS. 2, 3 and 4 illustrates steps in constructing the arrangement of FIG. 1.
Figure 4:
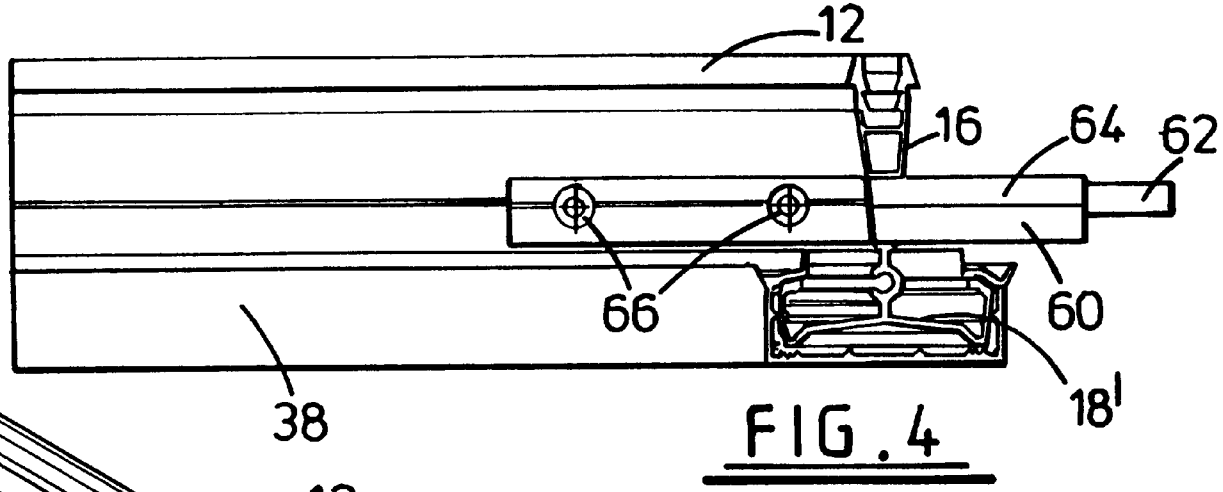
Figure 3:
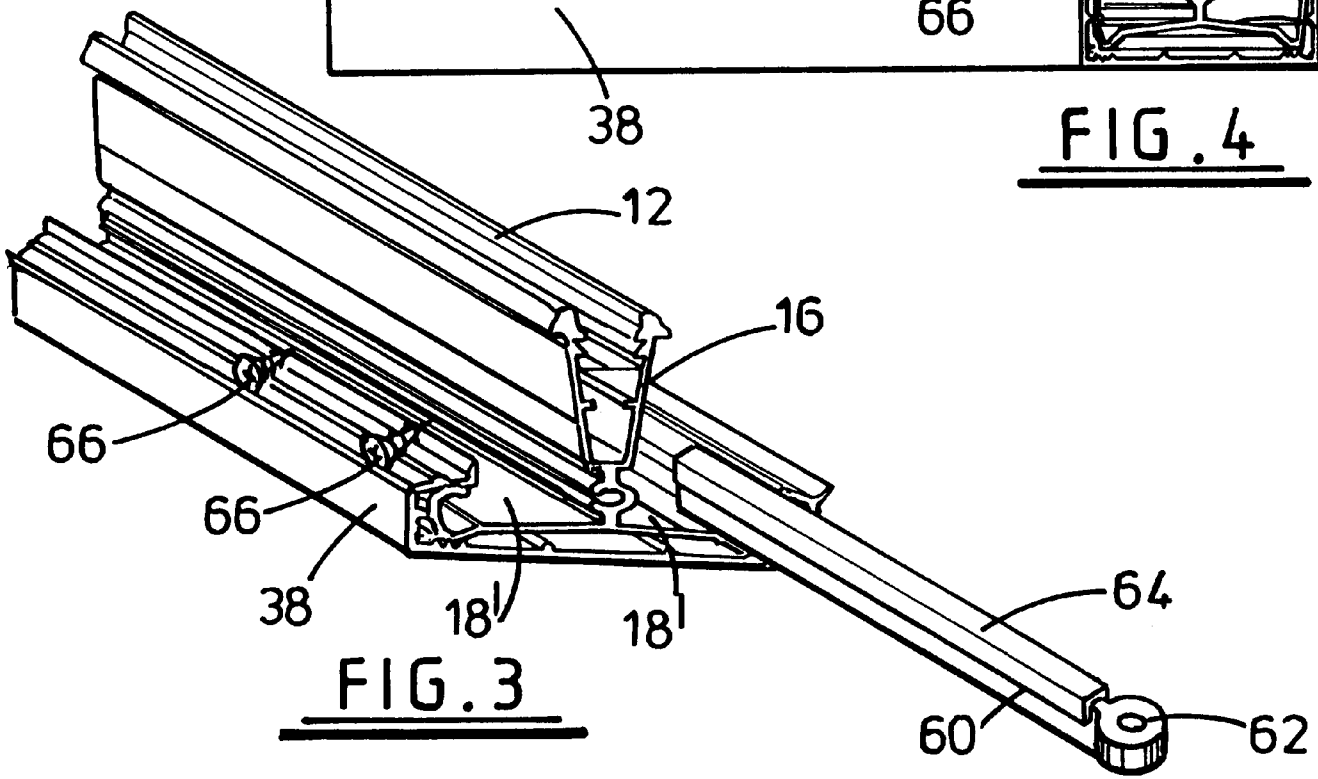
Figure 5:
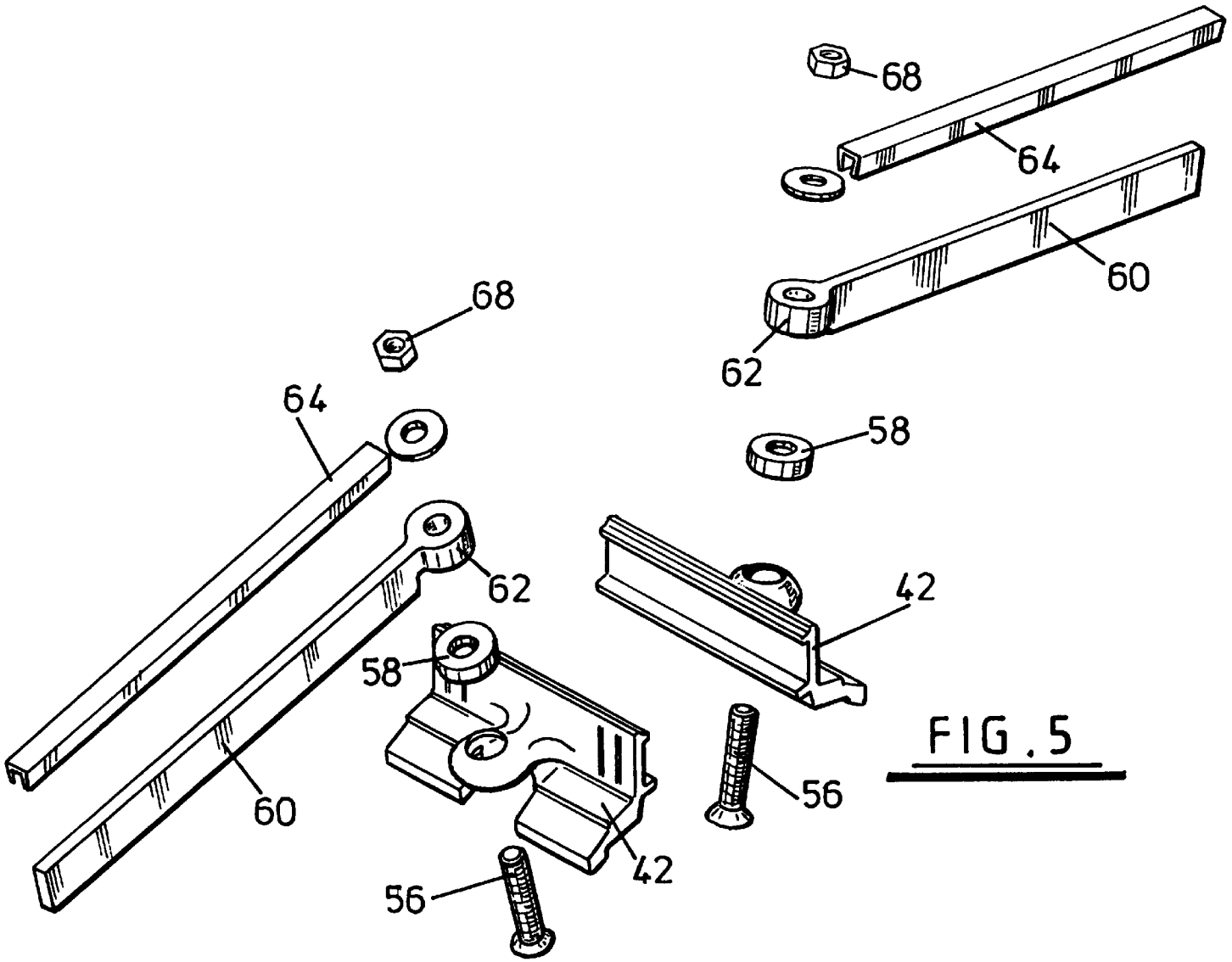
FIG. 5 is an exploded view of components of jack rafter connectors according to the invention.
Figure 7:
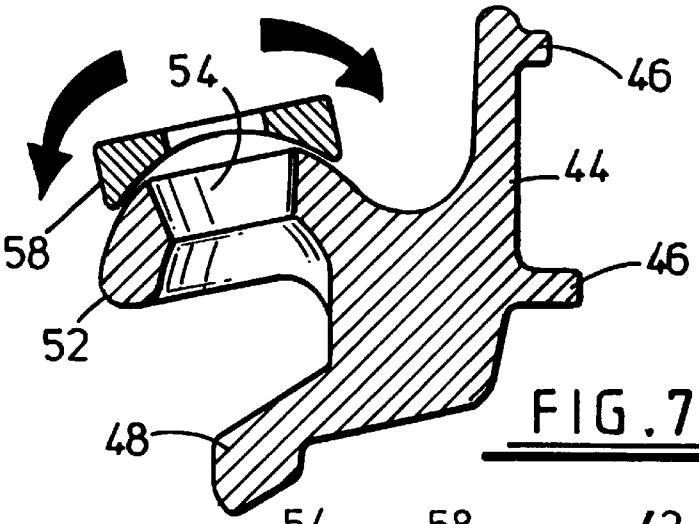
FIG. 7 is a section through the component of FIG. 6.
Figure 6:
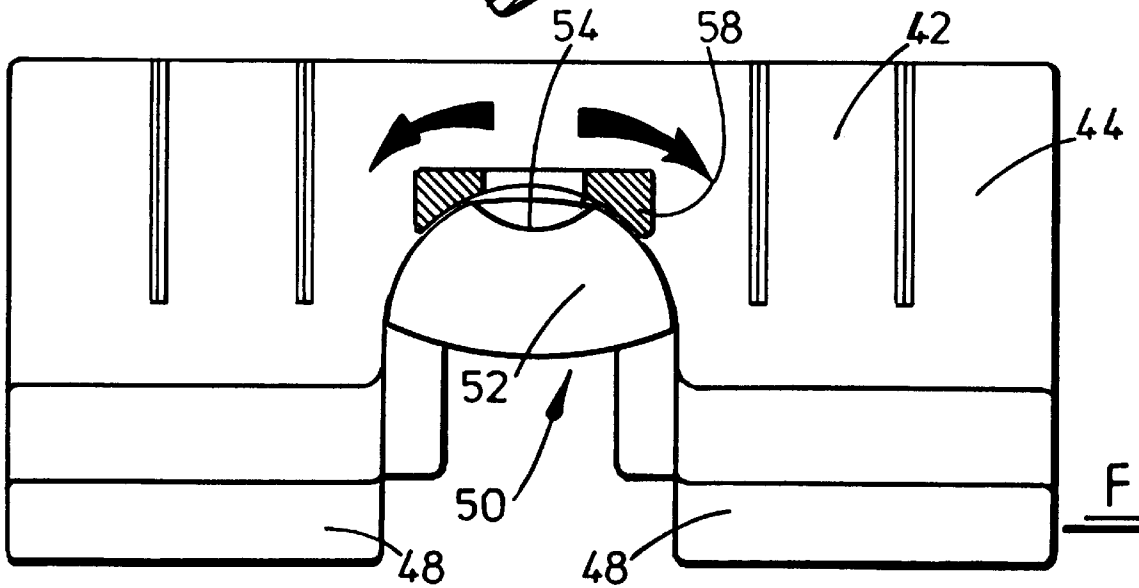
FIG. 6 is a front elevation of a connector component.

Referring to the accompanying drawings, a jack rafter arrangement for a conservatory roof, typically referred to as a Georgian style roof, comprises a main glazing beam 10, which will extend from a ridge of the roof to its eaves, and a jack rafter 12 which extends from the main beam 10 to the eaves at an acute angle. The main beam 10 and the rafter 12 are joined by a connector generally designated 14.

The main beam 10 and rafter 12 are of the same general type being of inverted T-section having a stem 16 and a pair of flanges 18, 18' respectively extending oppositely from a bottom end of the stem. The flanges 18 and 18' have upturned ends 20 with inwards returns 22. The flanges 18/18' include trough sections 24 at their ends and in the case of the main beam are angled downwardly more than the flanges of the rafter.

The stems 16 of the bar and rafter have a screw port 26 just above the flanges 18/18'. Above the screw port 26, the stem is in the form of a triangular section duct 28 with sides 30 diverging upwardly. Internally of the sides 30 are ribs 32. Above the duct 28 is a channel 34 with internal ribs 36 to retain formation of a top cap (not shown). The glazing beam 10 and rafter 12 are of a type described in our co-pending U.K. Patent Applications Nos. 9615743.3 and 9618984.0. Other similar types of glazing beam disclosed in either of those applications may be used in place of those illustrated herein.

The main beam 10 and rafter 12 have channel section lower cappings 38 fitted. These cappings have co-extruded gaskets 40 extending inwardly from top edges of the channels. The gaskets fit over the inwards returns of the flanges 18/18' so that in a finished roof they are held in place by glazing material, which in turn is held in place by top cappings (not shown). Our above-mentioned U.K. Patent Applications illustrate that type of arrangement.

The connector 14 comprises a main composite plastics block 42 that is generally L-shaped in section to fit into the angle of the stem 16 and flange 18 of the glazing beam 10 where it is secured by screws 43. The block 42 has a vertical limb 44 that has a pair of spaced ribs 46 on its outer face. These ribs space the limb 44 from the stem 16 to leave a gap to accommodate a steel reinforcement strip (not shown) for the glazing beam. The block has a horizontal limb 48 in two parts with a gap 50 therebetween. Extending from the vertical limb over the gap 50 is a projection 52 having a through hole 54 to receive a threaded bolt 56. The projection 52 has a rounded top surface on which is fitted a composite plastics washer 58 having a concave underside so that it can be moved over the projection 52. A bar 60 has a ring 62 at one end to fit over the bolt 56 to be secured in place by a nut 68 on the bolt 56. The other end of the bar 60 slots into the duct 28 of the rafter stem 16 below the internal ribs 32. A flexible PVC channel section sleeve 64 is provided on the top of the bar 60 to centralise the bar within the duct 26, where it is secured by screws 66 through the stem wall into the bar.

Because of the provision of the combination of the rounded projection 52 and the concave washer 58, it is possible to accommodate different angles of the bar 60 both relative to the vertical plane of the main beam 10 and to a plane normal to said vertical plane and hence of the rafter 12.

What is claimed is:

1. A roof having a ridge and eaves and a main beam extending between the ridge and eaves, a jack rafter extending from the main beam to the eaves at an angle to the main beam, means for connecting the jack rafter to the main beam comprising a first part mounted on the main beam and a second part connected to the jack rafter and connected to the first part, wherein the first and second parts are relatively pivotable to achieve a desired position for the rafter relative to the main beam.

2. A roof as claimed in claim 1, wherein connection between the first and second parts permits relative pivoting of said parts both relative to a vertical plane through the main beam and to a plane normal to the vertical plane of the main beam.

3. A roof as claimed in claim 1, wherein the first connector part has a part to take a connecting bolt, which part has a rounded top surface.

4. A roof as claimed in claim 3, wherein the second connector part includes a bar with a hole in one end fitted onto the connecting bolt.

5. A roof as claimed in claim 3, wherein the second connector part has a concave underside.

6. A roof as claimed in claim 3, wherein a washer having a concave underside is interposed between the first and second connector parts.

7. A roof as claimed in claim 1, wherein the jack rafter comprises a glazing bar having a ducted web into which is fitted the second connector part.

8. A roof having a ridge and eaves and a main beam extending between the ridge and eaves, a jack rafter extending from a main beam to the eaves at an angle to the main beam, means for connecting the jack rafter to the main beam comprising a first part mounted on the main beam and a second part connected to the jack rafter and connected to the first part, wherein the first and second parts are relatively pivotable both relative to a vertical plane through the main beam and to a plane normal to the vertical plane of the main beam to achieve a desired position for the jack rafter relative to the main beam.

9. A roof having a ridge and eaves and a main beam extending between the ridge and eaves, a jack rafter extending from the main beam to the eaves at an angle to the main beam, means for connecting the jack rafter to the main beam comprising a first connector part mounted on the main beam and having a part to take a connecting bolt, which part has a rounded top surface, and a second connector part connected to the jack rafter and to the first connector part, wherein the second connector part has a concave underside and hole therethrough fitted onto the connecting bolt, whereby the first and second parts are relatively pivotable to achieve a desired position for the jack rafter relative to the main beam.

* * * * *